US005497049A

United States Patent [19]

Fischer

[11] Patent Number: 5,497,049

[45] Date of Patent: Mar. 5, 1996

[54] HIGH PRESSURE MERCURY DISCHARGE LAMP

[75] Inventor: Hanns E. Fischer, Stolberg, Germany

[73] Assignee: U.S. Philips Corporation, New York, N.Y.

[21] Appl. No.: 46,426

[22] Filed: Apr. 12, 1993

[30] Foreign Application Priority Data

Jun. 23, 1992 [EP] European Pat. Off. ..... 92201858

[51] Int. Cl.[6] ..... H01J 17/16; H01J 61/30

[52] U.S. Cl. ..... 313/634; 313/571; 313/639; 313/642

[58] Field of Search ..... 313/570, 571, 313/640, 634, 639, 640, 642

[56] References Cited

U.S. PATENT DOCUMENTS

| | | | |
|---|---|---|---|
| 4,161,672 | 7/1979 | Cap et al. | 313/620 |
| 4,612,475 | 9/1986 | Downing | 313/640 |
| 4,686,419 | 8/1987 | Block et al. | 313/641 |
| 5,028,843 | 7/1991 | Narita | 313/641 |
| 5,109,181 | 4/1992 | Fischer et al. . | |
| 5,128,589 | 7/1992 | Dakin | 313/634 |
| 5,239,230 | 8/1993 | Mathews et al. | 313/571 |

FOREIGN PATENT DOCUMENTS

| | | |
|---|---|---|
| 0338637 | 10/1989 | European Pat. Off. . |
| 0500169 | 8/1992 | European Pat. Off. . |

*Primary Examiner*—Sandra L. O'Shea
*Assistant Examiner*—Matthew J. Esserman
*Attorney, Agent, or Firm*—Brian J. Wieghaus

[57] ABSTRACT

The high pressure mercury discharge lamp comprises a quartz glass lamp vessel (1) having a region (2) surrounding a discharge space (3), spaced-apart tungsten electrodes (4) defining a discharge path (5) disposed in the lamp vessel, and connected to current conductors (6) which extend from the lamp vessel to the exterior and a filling of mercury, rare gas and bromine. The lamp has an operating pressure of at least about 200 bar. The discharge space (3) is spheroidal in shape and has specified dimensions. The lamp consumes a power of 70 to 150 W. The lamp has favourable properties which render the lamp suitable for use in optical systems, e.g. for projection purposes.

17 Claims, 1 Drawing Sheet

HIGH PRESSURE MERCURY DISCHARGE LAMP

BACKGROUND OF THE INVENTION

The invention relates to a high pressure mercury discharge lamp comprising a quartz glass lamp vessel having a region surrounding a discharge space;

spaced-apart tungsten electrodes defining a discharge path, disposed in the lamp vessel, and connected to current conductors which extend from the lamp vessel to the exterior;

a filling of at least 0.2 mg Hg/mm$^3$, $10^6$ -$10^{-4}$ μmol/Hal/mm$^3$, wherein Hal is selected from Cl, Br and I and rare gas in the discharge space.

Such a lamp is known from EP 0 338 637-A2.

The known lamp has the advantage that, owing to its high operating pressure of at least 200 bar, its radiation contains a substantial amount of continuous radiation in the visible portion of the spectrum. The lamp has a long life, a high lumen maintenance and a small variation of its color point during its life.

The lamp known from said EP Application has an elongate, narrow, cylindrical or elliptical lamp vessel and consumes a low power of no more than 50 W. For many purposes, such as e.g. image projection, the luminous flux of the known lamp is too small. The lamp is, however, already highly loaded by more than 1 W/mm$^2$.

Investigations revealed that in order to obtain the high operating pressure, it is necessary to achieve a temperature of at least about 1160 K at any spot inside the lamp vessel. On the other hand, however, no spot of the wall of the discharge space is allowed to have a temperature of more than about 1390 K. Higher temperatures would induce crystallization of the quartz glass, which would bring about the destruction of the lamp vessel. Thus, the range of temperatures between the minimum temperature required and the maximum temperature permitted is very narrow.

This narrow range prevents the known lamp from being more highly loaded in order to consume a higher power. Also, it appears to be impossible to obtain a higher power consumption, while maintaining a long useful life, by enlarging the dimensions of the lamp vessel by normal up-scaling methods. In doing so, convection currents inside the discharge space would increase. This would have the effect that wall portions above the discharge would get an increased thermal load, whereas portions below the discharge would be loaded at too low a level.

Nevertheless, there is a strongly felt need for a lamp of very high luminosity, comparatively stable, comparatively high luminous efficacy, comparatively stable color point and long life, and a higher luminous flux than the lamp of the opening paragraph, e.g. for LCD projection TV. Metal halide lamps, for instance, fail in this respect, since the relatively large amounts of halogen present as halides cause corrosion of the electrodes. This results in color shifts, power changes, wall blackening and a reduced light output.

SUMMARY OF THE INVENTION

It is an object of the invention to provide an electric lamp of very high luminosity, comparatively stable, comparatively high luminous efficacy, comparatively stable color point and long life, and a comparatively high luminous flux.

According to the invention, this object is achieved with a high pressure mercury discharge lamp of the kind described in the opening paragraph, which is characterized by the whole of the following features taken in their combination:

a) the discharge space is spheroidal in shape, having a dimension S in the direction of the discharge path which is S (ram)=e*$D_i$, wherein e is in the range of 1.0–1.8, $D_i$ (mm)=f*(3.2+0.011)mm/W)*P(W)),wherein $D_i$ is the largest inside diameter (of the discharge space) transverse to the discharge path, f has a value in the range of 0.9–1.1, and P is the power consumed at nominal operation, which is in the range of 70–150 W, b) the lamp vessel has in the region surrounding the discharge space a convex outer surface, which in a plane in which $D_i$ is situated has an outside diameter $D_o$ which is $D_o$ (mm)≧3.2+0.055(mm/W)*P(W), c) the length of the discharge path $D_p$ is in the range of 1.0–2.0 mm, and d) bromine is the selected halogen.

Quite surprisingly the lamp of the invention as defined above the claim taken as a whole of mutually dependent features fulfils the object of the invention. For instance, when the size S of the discharge space is outside the range specified, portions of the wall of the discharge space become too cold to obtain the operating pressure required. The discharge space is either purely spherical or rather bulkily ellipsoidal. This is in contrast to the lamp of the EP Application cited. Said application mentions an elongate cylindrical envelope of a 30 W low power lamp, having a length/diameter ratio of 2.7. The known 40 W lamp has a length/diameter ratio of 2.0, but the known lamp of highest power, 50 W, is more elongate and has a length/diameter ratio of as much as 2.8.

When $D_i$ is below than the range specified, the lamp becomes overheated and suffers from a premature failure. When $D_i$ is above the range specified, the lamp has cold spots and does not attain the pressure required. Favorably, f has a value in the range of 0.92– 1.08, more particularly in the range of 0.95–1.05.

When $D_o$ is smaller than specified portions of the wall of the discharge space present above the discharge have too high a temperature and the lamp suffers a premature failure. There is no critical upper limit to $D_o$. Considerations such as the avoidance of unnecessary expense for quartz glass and the cost of manufacturing steps play a part in choosing an actual size, e.g. up to 2 mm larger than the minimum size.

The discharge path has the length specified to avoid overheating at lower values than defined and cold spots at higher values. Quite generally, lower values in the range will be used with lower power consumptions in the range and vice versa.

Bromine in an amount within the range specified is essential, because in such a broad range, which provides for the essential tolerances in manufacturing processes on a technical scale, bromine is able to prevent the lamp vessel from becoming blackened and to avoid the electrodes from becoming attacked. Below the range, blackening by evaporated tungsten occurs and attack of the electrodes occurs above the range specified. If iodine were used as the halogen such a high amount would be necessary to prevent blackening that deformation of the tip of the electrodes is likely. If chlorine were used, such a small amount could be used only, in order to prevent attack of colder electrode portions, that the risk exists of impurities present in the lamp binding the chlorine and excluding any tungsten/chlorine cycle which should keep the wall clean.

Limits are set as to the power consumed, because at lower powers the usefulness of the lamp is impaired, whereas at higher powers the conditions of the minimum and the maximum permissible temperatures cannot be fulfilled simultaneously.

The lamp of the invention has a comparatively high yield of 60 lm/W. Because of its relatively high power and the small dimensions of its arc, the discharge path is at most 2 mm long, the lamp has a very high luminosity. The lamp, therefore, is well suited to be used in optical systems. The coordinates of the color point of the light generated shift only slightly, e.g. $\Delta x$ and $\Delta y<0.005$ after 5000 hrs.

The lamp of the invention is very well suited to be used for projection purposes, e.g. for the projection of images created by a liquid crystal display panel, e.g. a panel creating moving pictures. Other uses are e.g. search lights, beacons, fiber optical applications, e.g. as the central light source, and endoscopy.

The usefulness of a high pressure mercury lamp of the invention appears from the following Table 1, in which the properties of the various lamps used in LCD projection TV sets are compared.

TABLE 1

| lamp type | power (W) | luminous flux on screen (1 m) | maintenance (%) after 4000 hrs |
|---|---|---|---|
| tin halide | 200 | >120 | 60 |
| rare earth metal hal. | 200 | >120 | 0 |
| Hg | 100 | >120 | >80 |

It appears from the Table that the tin halide lamp, the rare earth halide lamp and an embodiment of the high pressure mercury discharge lamp of the invention (Hg) give the same amount of light on an LCD projection TV screen, although the Hg lamp of the invention consumes only half the power of the other lamps. The maintenance of the luminous flux on the screen after 4000 hrs of operation is greatest in the case of the Hg lamp. The rare earth lamp failed at an earlier stage.

In an embodiment, the lamp of the invention is secured to a lamp cap, the current conductors being connected to contacts of the cap. In a favorable embodiment, the lamp cap has protrusions facing the discharge space which are tangent to an imaginary sphere having its center of curvature in the discharge path, as is disclosed in Applicant's non-prepublished EP Application 92 200 385. The lamp of this embodiment is well suited to be used in an optical system having a ring shaped spherical surface for receiving said protrusions in an abutting manner in order to arrange the discharge path in the optical system in a predetermined position, without the need to align the lamp with respect to the system.

BRIEF DESCRIPTION OF THE DRAWINGS

Embodiments of the high pressure discharge lamp of the invention are shown in the drawing, in which.

DETAILED DESCRIPTION OF THE PREFERRED EMBODIMENTS

Figure 1:
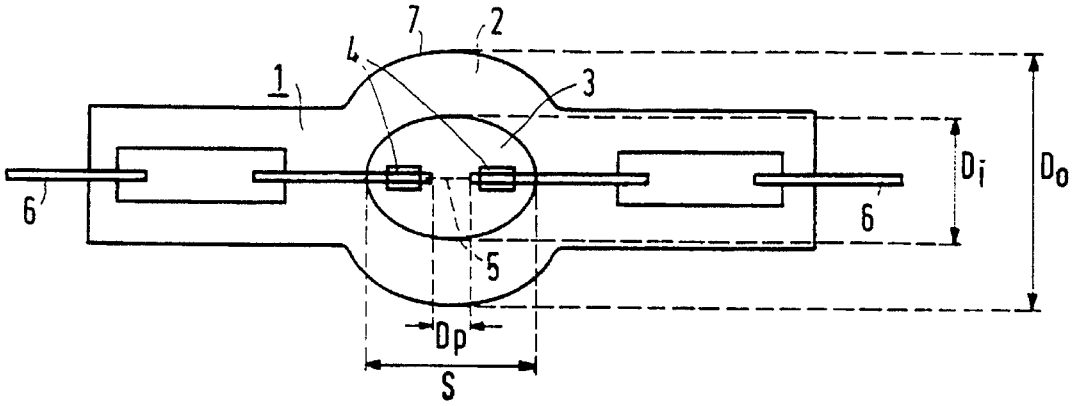
FIG. 1 is an elevation of a lamp.

The high pressure mercury discharge lamp of FIG. 1 comprises a quartz glass lamp vessel 1 having a region 2 surrounding a discharge space 3. Spaced-apart tungsten electrodes 4 defining a discharge path 5 are disposed in the lamp vessel and are connected to current conductors 6 which extend from the lamp vessel to the exterior. The lamp vessel has a filling of at least 0.2 mg Hg/mm$^3$, $10^{-6}$ - $10^{-4}$ μmol Hal/mm$^3$, wherein the Hal selected is Br and rare gas in the discharge space.

The discharge space 3 is spheroidal in shape and has a dimension S in the direction of the discharge path 5 which is $S\ (mm)=e*D_i$, wherein e is in the range of 1.0–1.8, $D_i\ (mm)=f*(3.2+0.011(mm/W)*P(W))$, wherein $D_i$ is the largest inside diameter transverse to the discharge path 5, f has a value in the range of 0.9–1.1, and P is the power consumed at nominal operation, which is in the range of 70–150 W.

The lamp vessel 1 has in the region 2 surrounding the discharge space 3 a convex outer surface 7, which in an outside plane in which $D_i$ is situated has a diameter $D_o$ which is $D_o\ (mm)\geqq 3.2+0.055\ (mm/W)*P(W)$. The length of the discharge path $D_p$ is in the range of 1.0–2.0 mm. Parameters of the lamp shown are represented in the column Ex. 1 of Table 2.

It is suitable for the outer surface of the lamp of the invention to be substantially spherical in shape in the region surrounding the discharge space, as is shown in the drawing.

Figure 2:
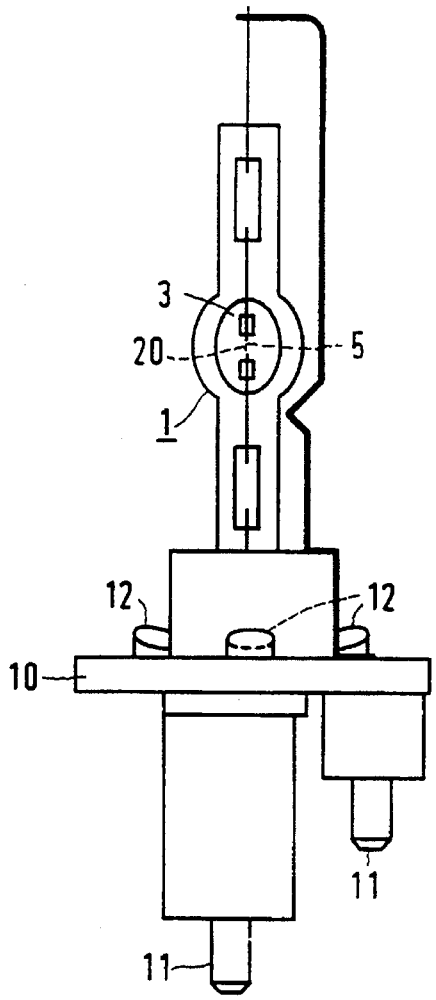
FIG. 2 is an elevation of a capped lamp.

In the embodiment of FIG. 2, the lamp of FIG. 1 is mounted in a lamp cap 10 having contacts 11 to which respective current conductors 6 are connected. The lamp cap has protrusions 12 facing the discharge space 3 which are tangent to an imaginary sphere having its center of curvature 20 in the discharge path 5. The lamp of this embodiment is well suited to be used in an optical system having a ring shaped spherical surface for receiving said protrusions in an abutting manner in order to arrange the discharge path in the optical system in a predetermined position, without the need to align the lamp with respect to the system.

TABLE 2

| | Ex. 1 | Ex. 2 | Ex. 3 | Ex. 4 |
|---|---|---|---|---|
| P (W) | 100 | 130 | 70 | 150 |
| S (mm) | 6.0 | 6.8 | 5.5 | 7.5 |
| e | 1.4 | 1.5 | 1.38 | 1.56 |
| $D_i$ (mm) | 4.3 | 4.5 | 4.0 | 4.8 |
| f | 1.0 | 0.97 | 1.01 | 0.99 |
| $D_o$ (mm) | 9.0 | 10.5 | 7.5 | 12.0 |
| $D_p$ (mm) | 1.4 | 1.8 | 1.2 | 2.0 |
| filling: | | | | |
| Hg (mg/mm$^3$) | 0.207 | 0.208 | 0.217 | 0.205 |
| Br (μmol/mm$^3$) | $10^{-5}$ | $10^{-5}$ | $10^{-5}$ | $10^{-5}$ |
| Ar (mbar) | 100 | 100 | 100 | 100 |

Examples of the high pressure mercury discharge lamp of the invention are represented in the foregoing Table 2.

Amongst others a large number of lamps of the kind defined and identified in Table 2 as Ex. 1 were manufactured. These lamps were compared with lamps not according to the invention. The latter lamps had $D_i$ values of $\leqq 3.8$ mm and $\geqq 4.8$ mm respectively, but were for the rest identical to the lamp of Ex. 1. The species having said lower value of $\leqq 3.8$ mm exhibited considerable crystallization of the lamp vessel already after 100 hours of operation. Several of them exploded spontaneously before 1000 hours of operation were attained. Also the species having said higher $D_i$ values of $\geqq 4.8$ mm showed crystallization. Moreover, some of them exhibited strong deformations of the lamp vessel due to overheating. Only 3 out of 20 reached a life of >2000 hours. No failures occurred, however, in a series of 40 lamps according to the invention, which either were of the kind identified as Ex. 1, or had another value of $D_i$ within the range specified and for the rest were identical to the lamp of Ex. 1. The lumen maintenance of these lamps after 2000 hours of switched operation was better than 90%.

I claim:

1. A high pressure mercury discharge lamp, comprising:

a quartz glass lamp vessel having a region surrounding a discharge space;

spaced-apart tungsten electrodes disposed in the lamp vessel and defining a discharge path $D_p$ current conductors connected to said electrodes and which extend through the lamp vessel to the exterior;

a filling of at least 0.2 mg Hg/mm$^3$, $10^{-6}$ - $10^{-4}$ μmol Br/mm$^3$ and a rare gas in the discharge space, the discharge space being spheroidal in shape, having a dimension S in the direction of the discharge path which is S (mm)=e*$D_i$, wherein e is in the range of 1.0–1.8, $D_i$ (mm)=f*(3.2+0.011(mm/W)*P(W)), wherein $D_i$ is the largest inside diameter of the discharge vessel transverse to the discharge path, f has a value in the range of 0.9–1.1, P is the power consumed at nominal operation, which is in the range of 70–150 W, the lamp vessel having in the region surrounding the discharge space a convex outer surface, which in a plane in which $D_i$ is situated has an outside diameter $D_o$ which is $D_o \geqq 3.2+0.055$ (mm/W)*P(W), and the length of the discharge path $D_p$ is in the range of 1.0–2.0 mm.

2. A high pressure mercury discharge lamp as claimed in claim 1, further comprising a lamp cap holding said discharge vessel and having a pair of contacts, the current conductors being secured to respective contacts thereof.

3. A high pressure mercury discharge lamp as claimed in claim 2, characterized in that the lamp cap has protrusions facing the discharge space which are tangent to an imaginary sphere having its center of curvature in the discharge path.

4. A high pressure mercury lamp, comprising:

a) a lamp vessel having a portion enclosing a spheroidal discharge space having a volume, said portion having (i) an internal length dimension "S" defining a major axis of said spheroidal discharge space, (ii) a largest internal diameter "D" transverse to said length dimension defining a minor axis of said spheroidal discharge space, and (iii) a convex outer surface with an outside diameter "$D_o$" in the plane including $D_i$;

b) a pair of opposing discharge electrodes within said discharge space between which a discharge is maintained during lamp operation, said electrodes having distal tips aligned on said major axis of said discharge space and separated by a distance "$D_p$" defining the length of the discharge path between said distal tips;

c) means for connecting said discharge electrodes to a source of electric potential outside of said discharge vessel; and d) a filling within said discharge space comprising a rare gas, at least 0.2 mg Hg/mm$^3$ and $10^{-6}$ - $10^{-4}$ μmol Br/m$^3$ of the volume of the discharge space, wherein (i) said lamp during nominal lamp operation consumes a power "P" of between about 70 and about 150 W, (ii) the discharge path length $D_p$ is in the range 1.0– 2.0 mm, (iii) the length dimension S is defined by the equation S(mm)=e*$D_i$, where e is in the range 1.0–1.8 and $D_i$ (mm)=f*(3.2+0.011(mm/W)*P(W)), where f has a value in the range 0.9–1.1, and (iv) the outside diameter $D_o$ is defined by the equation $D_o$ (mm)$\geqq$3.2+0.055 (mm/W)*P(w).

5. A high pressure mercury lamp according to claim 4, wherein said discharge vessel comprises quartz glass.

6. A high pressure mercury lamp according to claim 5, wherein the variable "f" has a value in the range 0.92–1.08.

7. A high pressure mercury lamp according to claim 5, wherein the variable "f" has a value in the range 0.95–1.05.

8. A high pressure mercury lamp according to claim 5, wherein said portion enclosing said spheroidal discharge space has a spherical outer surface.

9. A high pressure mercury lamp according to claim 5, wherein said lamp has a maintenance of greater than 80% after 4000 hours of operation.

10. A high pressure mercury lamp according to claim 9, wherein the light emitted by said lamp has color point coordinates x,y which have a shift Δx, Δy each less than 0.005 after 5000 hours of operation.

11. A high pressure mercury lamp according to claim 10, wherein said lamp has a luminous efficacy of about 60 lm/W.

12. A high pressure mercury lamp according to claim 4, wherein said portion enclosing said spheroidal discharge space has a spherical outer surface.

13. A high pressure mercury lamp according to claim 4, wherein said lamp has a maintenance of greater than 80% after 4000 hours of operation.

14. A high pressure mercury lamp according to claim 13, wherein the light emitted by said lamp has color point coordinates x,y which have a shift Δx, Δy each less than 0.005 after 5000 hours of operation.

15. A high pressure mercury lamp according to claim 14, wherein said lamp has a luminous efficacy of about 60 lm/W.

16. A high pressure mercury lamp according to claim 4, wherein the variable "f" has a value in the range 0.92–1.08.

17. A high pressure mercury lamp according to claim 4, wherein the variable "f" has a value in the range 0.95–1.05.

* * * * *

UNITED STATES PATENT AND TRADEMARK OFFICE

CERTIFICATE OF CORRECTION

PATENT NO. : 5,497,049
DATED : March 5, 1996
INVENTOR(S) : Hanns E. Fischer

It is certified that error appears in the above-identified patent and that said Letters Patent is hereby corrected as shown below:

Column 5,
Line 50, change "D" to -- $D_i$ --.

Signed and Sealed this

Twelfth Day of November, 2002

*Attest:*

*Attesting Officer*

JAMES E. ROGAN
*Director of the United States Patent and Trademark Office*